US008446278B2

(12) United States Patent
Ivashin et al.

(10) Patent No.: US 8,446,278 B2
(45) Date of Patent: May 21, 2013

(54) SECURITY MONITOR FOR DOORS

(75) Inventors: Victor S. Ivashin, Santa Rosa, CA (US); John W. Webley, Santa Rosa, CA (US)

(73) Assignee: Innovative Labs LLC, Petaluma, CA (US)

( * ) Notice: Subject to any disclaimer, the term of this patent is extended or adjusted under 35 U.S.C. 154(b) by 592 days.

(21) Appl. No.: 12/647,334

(22) Filed: Dec. 24, 2009

(65) Prior Publication Data

US 2010/0170310 A1 Jul. 8, 2010

Related U.S. Application Data

(60) Provisional application No. 61/140,820, filed on Dec. 24, 2008, provisional application No. 61/140,815, filed on Dec. 24, 2008.

(51) Int. Cl.
*G08B 13/08* (2006.01)
*E05F 11/00* (2006.01)
*E05B 29/02* (2006.01)

(52) U.S. Cl.
USPC ..... 340/545.2; 340/545.6; 340/545.7; 160/188; 292/327

(58) Field of Classification Search ..... 340/540, 340/541, 542, 545.1, 545.6, 550, 552, 553, 340/556, 557, 545.2, 545.7; 292/307 R, 327; 160/188, 189
See application file for complete search history.

(56) References Cited

U.S. PATENT DOCUMENTS

| | | | | |
|---|---|---|---|---|
| 4,982,985 | A * | 1/1991 | Atlas | 292/327 |
| 5,111,184 | A * | 5/1992 | Heaton et al. | 340/542 |
| 5,656,867 | A * | 8/1997 | Kokubu | 307/10.5 |
| 6,069,563 | A * | 5/2000 | Kadner et al. | 340/571 |
| 6,568,454 | B1 * | 5/2003 | Mullet et al. | 160/188 |
| 7,143,804 | B2 * | 12/2006 | Mullet et al. | 160/188 |
| 2009/0058711 | A1 * | 3/2009 | Dixon et al. | 342/28 |
| 2009/0127873 | A1 * | 5/2009 | Terry et al. | 292/327 |
| 2009/0135015 | A1 * | 5/2009 | Dobson et al. | 340/572.9 |
| 2009/0146437 | A1 * | 6/2009 | Terry et al. | 292/281 |

* cited by examiner

*Primary Examiner* — Van T. Trieu
(74) *Attorney, Agent, or Firm* — IPxLAW Group LLP; Claude A. S. Hamrick

(57) ABSTRACT

A method and apparatus for monitoring the security of closures of the type used on large trucks, and shipping or other containers wherein one or more doors are provided on an end and/or the sides of the container and are secured by vertical rods having cam-like latches at their ends that are rotatable from a first disposition in which they engage keepers to lock the doors in a closed position, and a second disposition in which they disengage the keepers to unlock the doors and allow them to swing into an open position. More specifically, the present invention relates to a monitoring assembly that attaches between the locking rod handles of the containers, senses any movement of the locking handles or the opening of the doors, and provides visual signals and/or transmitted signals as an indication of tampering.

20 Claims, 15 Drawing Sheets

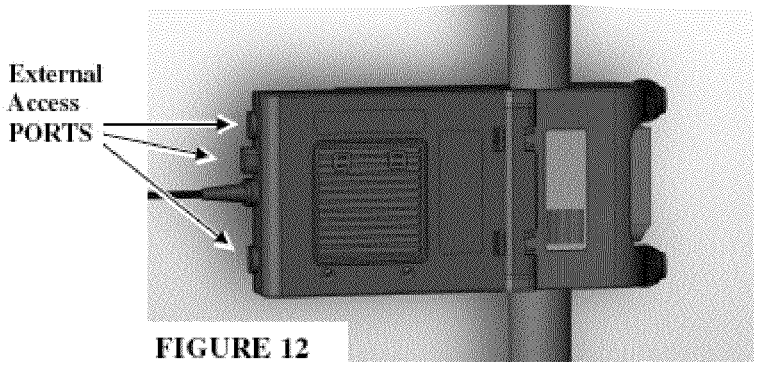
FIGURE 12
FIGURE 13
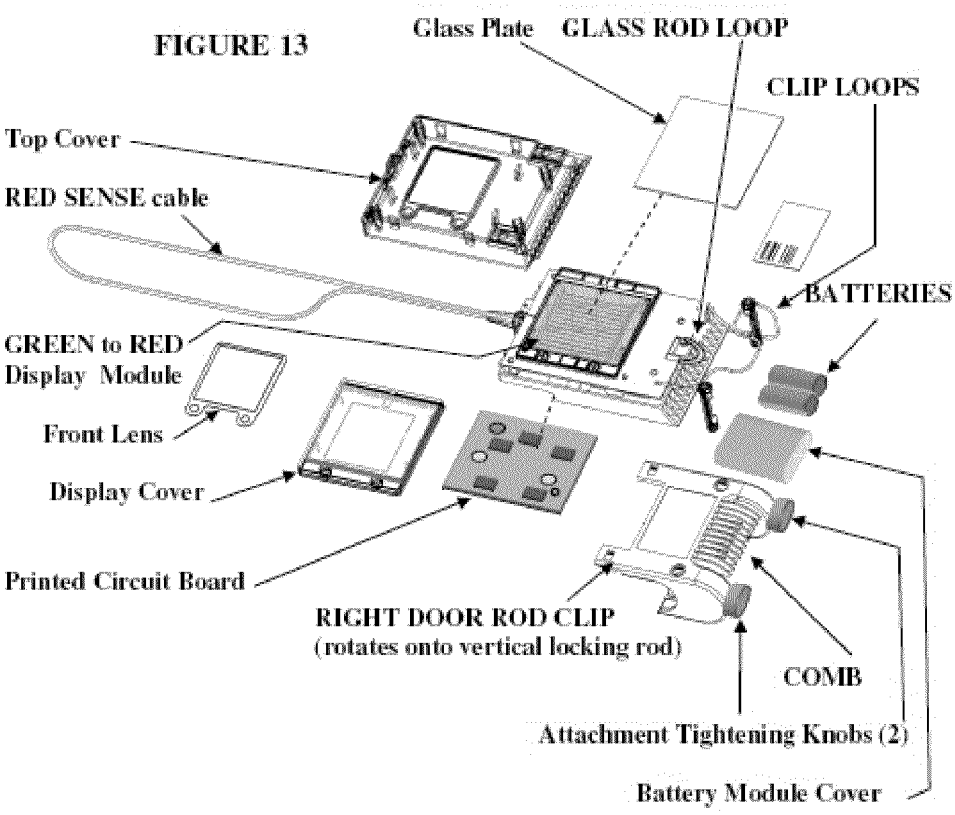

BLOCK DIAGRAM FIGURE 14

SECURITY MONITOR FOR DOORS

RELATED APPLICATIONS

This patent application claims the benefit under 35 USC 119(e) of U.S. Provisional Patent Application No. 61/140,820, filed on Dec. 24, 2008 and entitled "Security Monitor for Doors", and U.S. Provisional Patent Application No. 61/140,815, filed on Dec. 24, 2008 and entitled "Multiple Interlaced Displays Using Windowed Sheets", the disclosures of both applications being expressly incorporated hereinto by reference for all purposes.

FIELD OF THE INVENTION

The present invention relates generally to a method and apparatus for monitoring the security of closures of the type used on large trucks, and shipping or other containers wherein one or more doors are provided on an end and/or the sides of the container and are secured by vertical rods having cam-like latches at their ends that are rotatable from a first disposition in which they engage keepers to lock the doors in a closed position, and a second disposition in which they disengage the keepers to unlock the doors and allow them to swing into an open position. More specifically, the present invention relates to a monitoring assembly that attaches between the locking rod handles of the containers, senses any movement of the locking handles or the opening of the doors, and provides visual signals and/or transmitted signals as an indication of tampering.

BACKGROUND

Many types of anti-tamper locking and detection schemes and monitors are known in the prior. Notable among disclosures of such apparatus are those disclosed in the U.S. Patent Applications of Publications of Terry et al No. 20090146437 entitled "Reusable locking body, of bolt-type seal lock, having open-ended passageway"; Dobson et al No. 20090135015 entitled "Locking apparatus for shipping containers"; Terry et al No. 20090127873 entitled "Bolt-type seal lock having separate housing, connected to locking body, with electronics for detecting and wireless communicating cutting of bolt"; Evans et al No. 20090102660 entitled "Method and Apparatus for Tracking and Monitoring Containers"; Diener et al No. 20090102652 entitled "Apparatus for Detecting Tampering with a Latch Mechanism"; and Dixon et al No. 20090058711 entitled "Method and system for monitoring security of containers". However, most such container monitors are very expensive, use substantial power and are very bulky and their powered life is quite short. Simple locking mechanisms do not have history recording features, and visible displays are quite limited and the viewer must be quite close to see them.

SUMMARY

Briefly, a preferred embodiment of the present invention relates to a method and apparatus for monitoring the security of doors used on shipping or other containers wherein the doors exist at one end and/or on the sides of the container as two closures secured by vertical rods having cam-like latching mechanisms on their ends that engage keepers on the container allow the doors to swing open and one or more handles must be rotated to allow entrance into such containers. The apparatus attaches between the locking rod handles of the vertical rods and senses the opening of the doors or movement of the locking handle. The sensing of tamper activity is logged into an electronic memory, and indication is made with a highly visible display that changes from GREEN to RED to indicate that tampering has transpired. Further, a Radio Frequency Identification Device (RFID) device and radio circuit can be alerted as to the presence of the tampering, and in response, proper alarming action is started. Further, a localized micro-processor can act on the tamper status in several ways. Further, the micro-processor can be programmable to sense optional temperature, radiation, shock, bio-activity or other events and perform tasks accordingly. The monitor so developed can be made to be a one-time-use device and as such is disposable. The unit is self contained and battery powered.

The present invention provides a new method and apparatus for detecting the tampering of doors of shipping containers using a very inexpensive micro-processor based architecture that senses the movement of closure handles and allows the status of such tamper events to be displayed in an effective and highly visible way. The attachment of this tamper evident device is quite simple and the life of the electronics is set for at least 60 days of monitoring. Various sense ports allow different auxiliary monitoring functions, and a memory provides time information in the form of a tamper or status histogram. The addition of an RFID tag allows remote monitoring, and the electronics are capable of relaying information through an RF transmitter to allow wireless status information to be read at a remote location.

The present is embodied in a disposable unit having a highly visible tamper evidence display. It is battery operated, has a long 60 day service life and mounts as a single unit on variant dimensioned doors in just a few seconds. It is fully tamper-proof and utilizes unique serial numbers and means to avoid replication. It generates a histogram of time and tamper that is placed into electronic memory. The system employs fiber optic sensed loops for environmental robustness and has night-time and day-time status indication and RFID and barcode identifiers.

The present invention also has application in the monitoring of other types of doors or enclosures; for example, anywhere a GREEN (GO) or a RED (STOP) status needs to be displayed. It could be used for temperature monitors, fire alarm displays, mechanical controls, environmental status indicators or a myriad of other applications where a relatively long term monitoring activity is needed.

IN THE DRAWING

Figure 10:
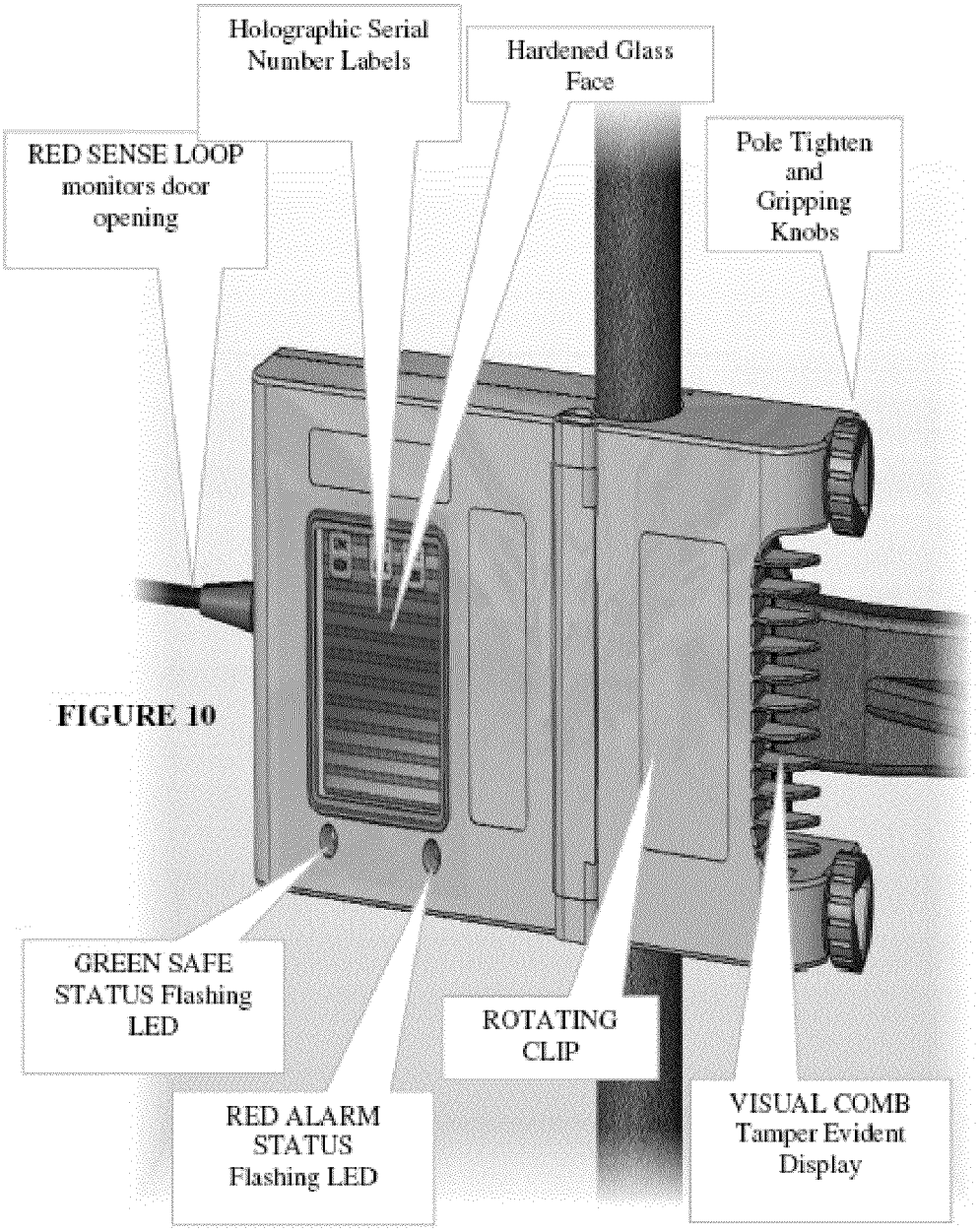
Figure 11:
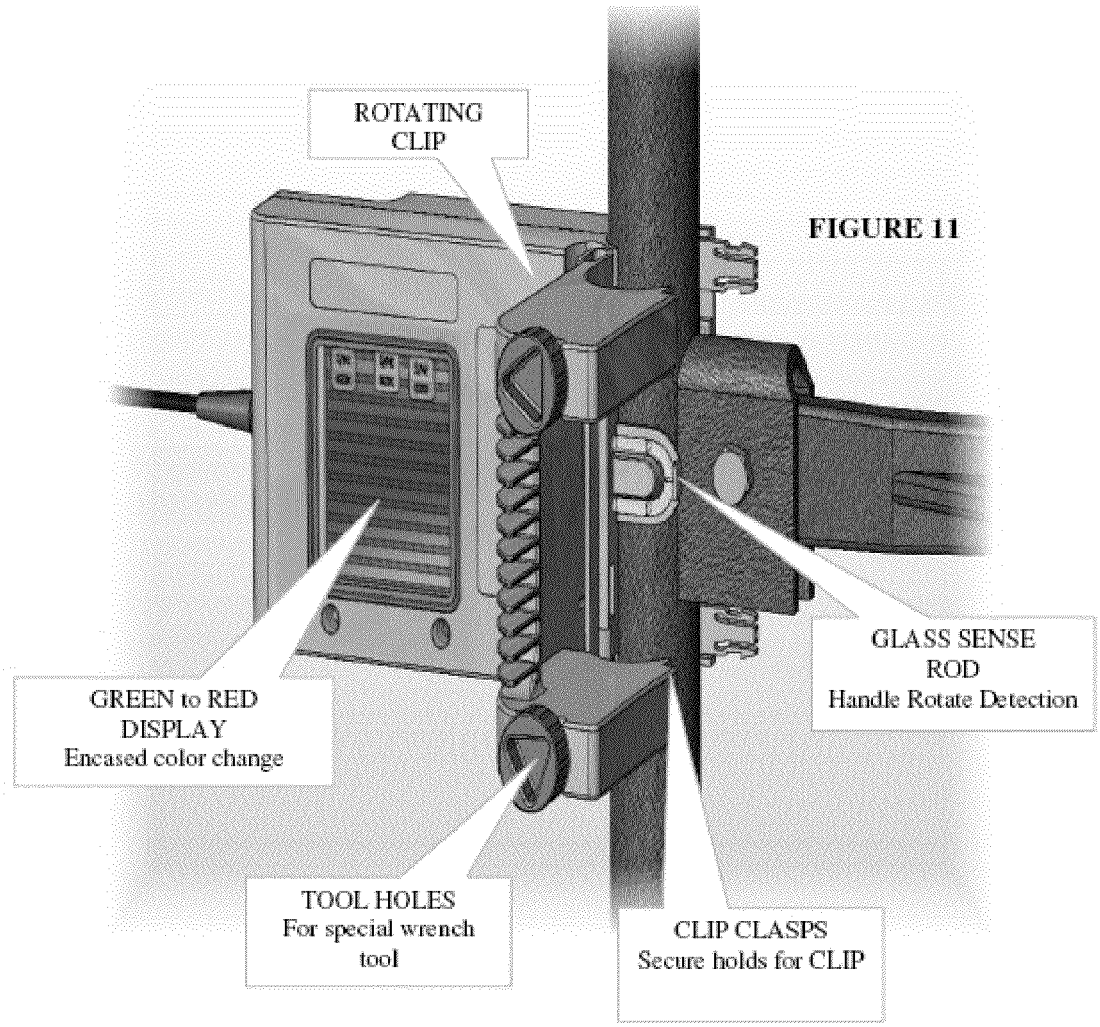
Figure 14:
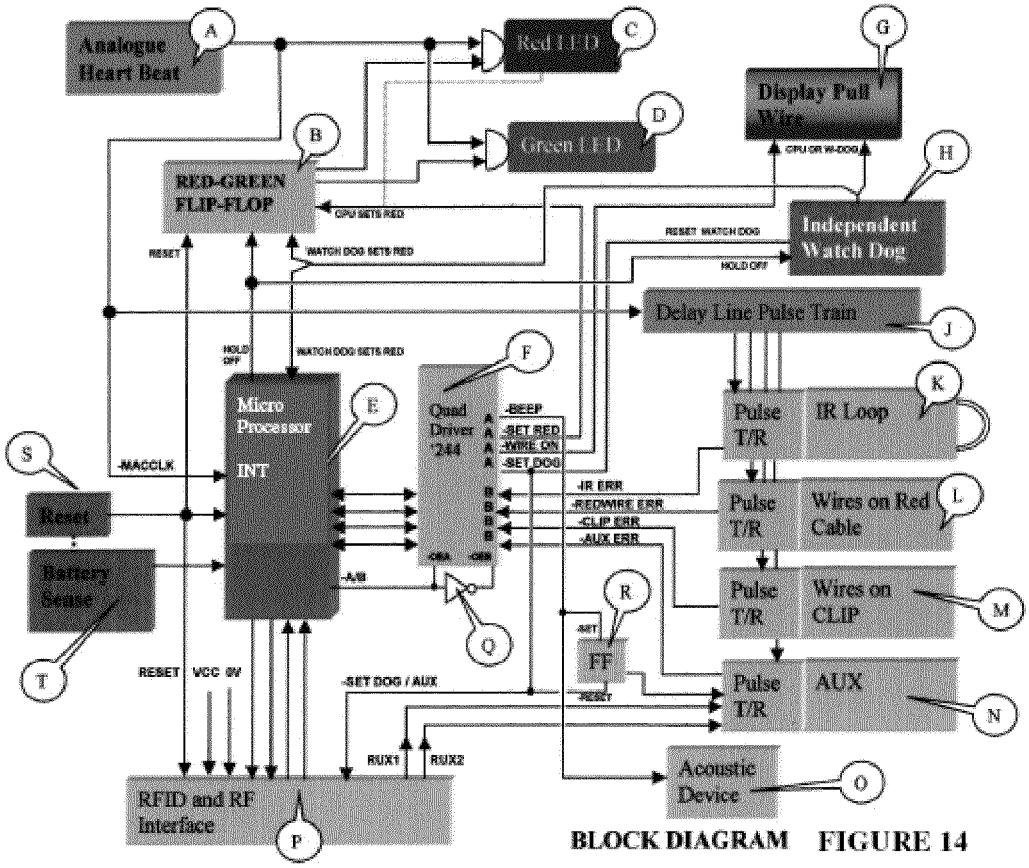
Figure 15:
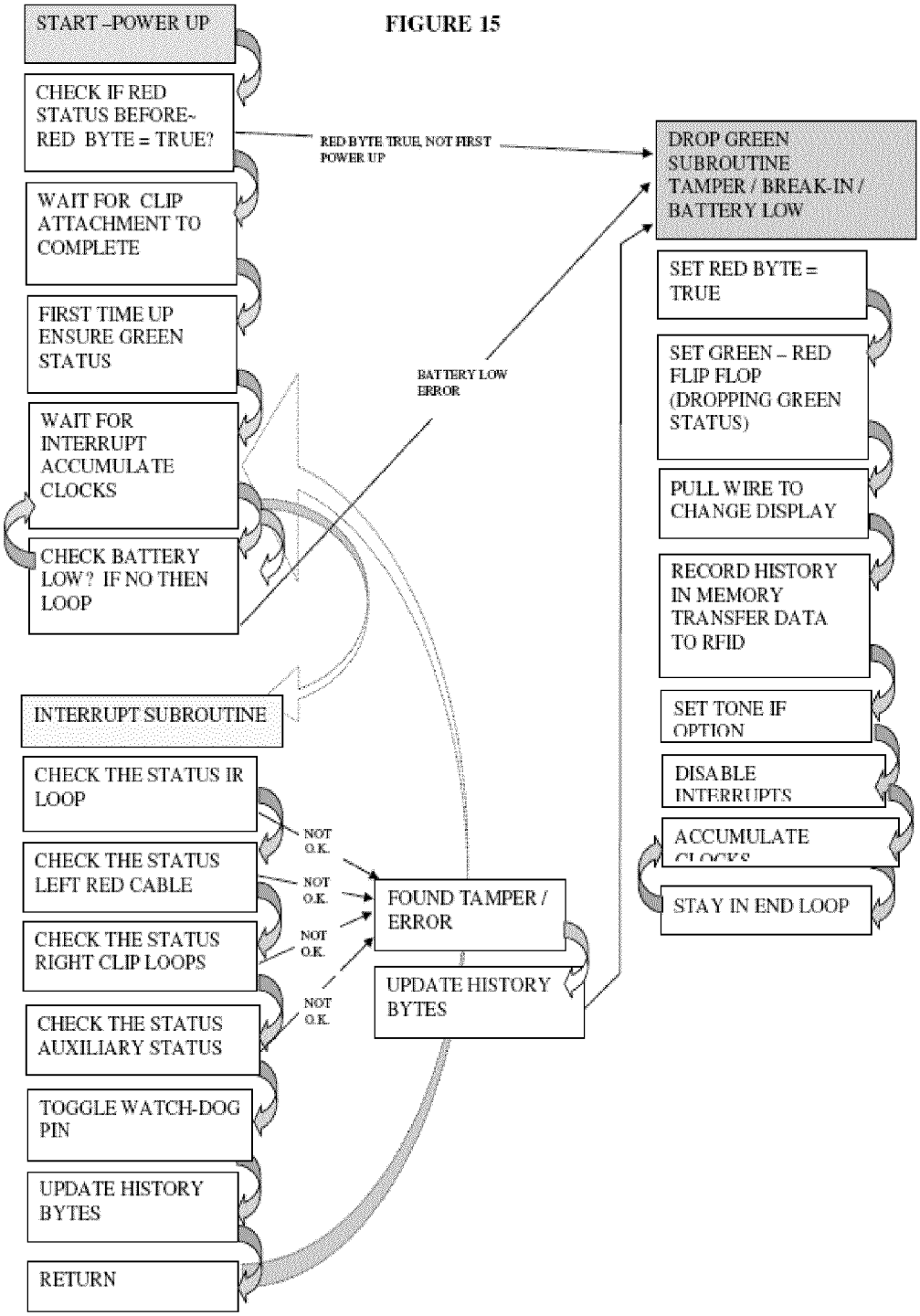
Figure 16:
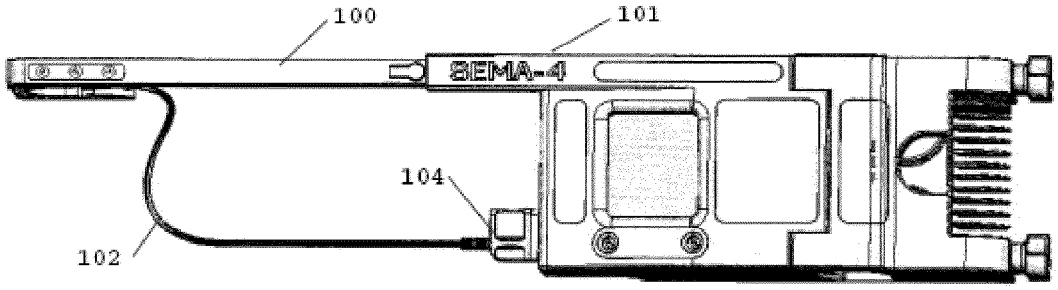
Figure 23:
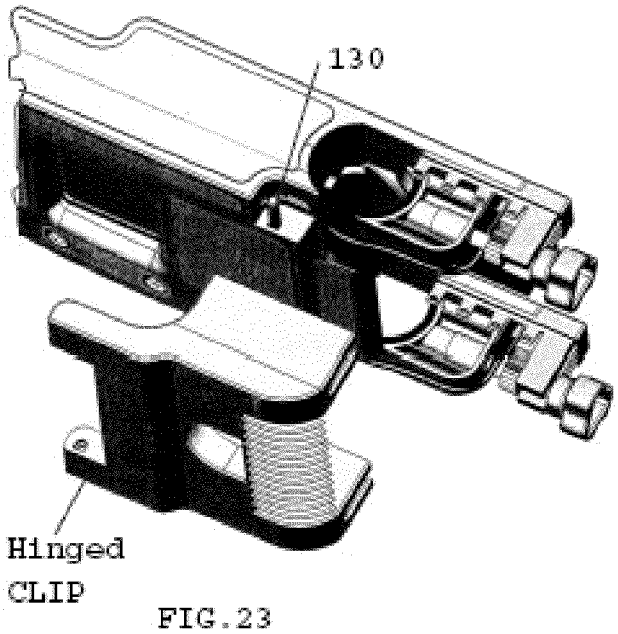
Figure 24:
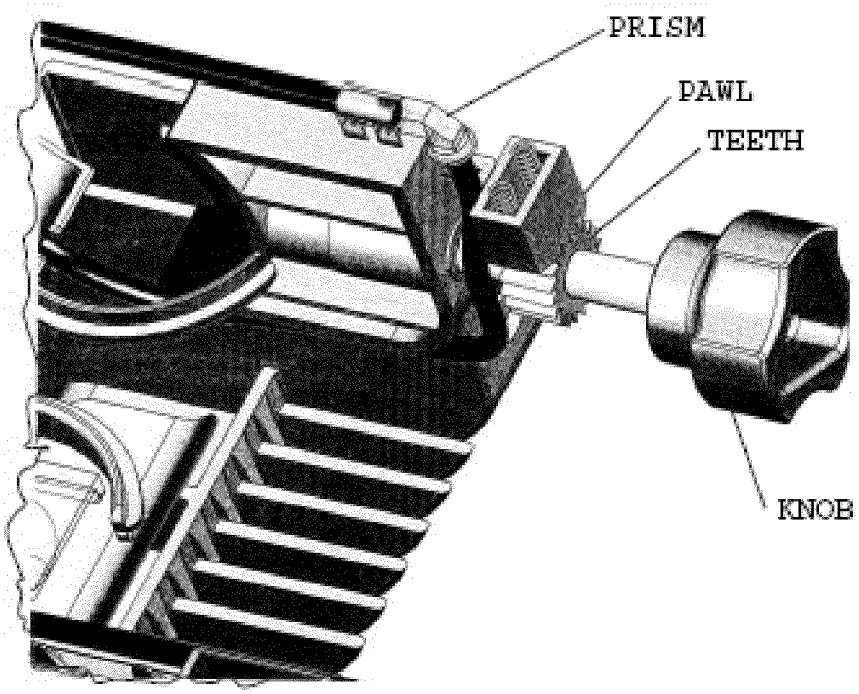
Figure 25:
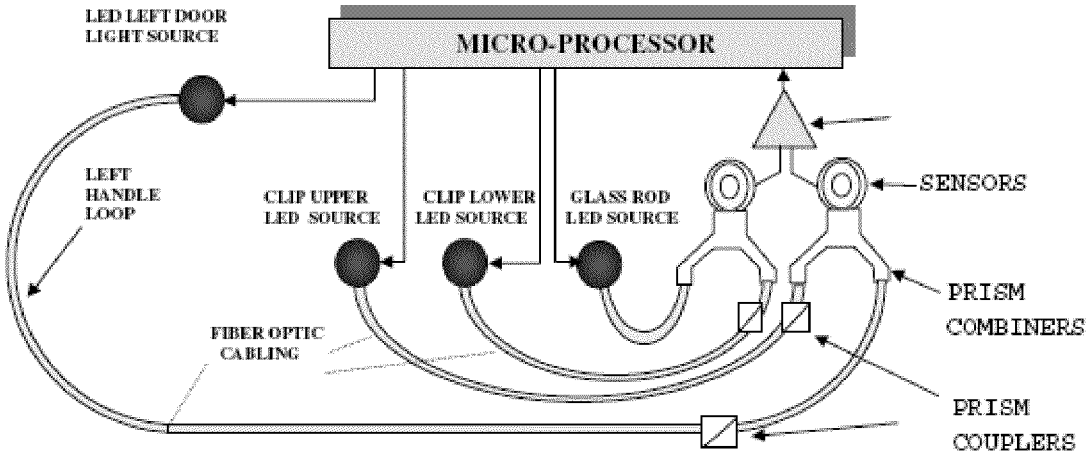
Figure 26:
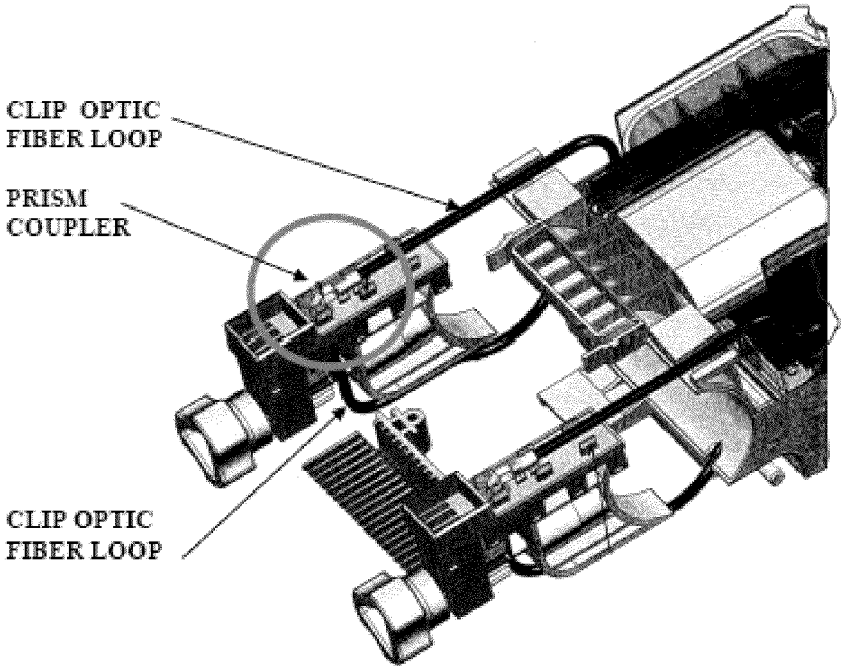

FIGS. 10 and 11 provides visual summaries of the several components of the embodiment;

FIG. 12 illustrates external communication access ports of the embodiment;

FIG. 13 is an exploded view showing the various component parts of the embodiment;

FIG. 14 is a block diagram showing the various functional components of the electronic sense and control system of the embodiment;

FIG. 15 is a diagram illustrating the basic firmware of the embodiment;

FIGS. 16-24 and 26 and 27 are perspective illustrations of an alternative embodiment in accordance with the present invention; and FIG. 25 is a schematic illustration of optical paths in the alternative embodiment.

DESCRIPTION OF EMBODIMENTS

Figure 1:
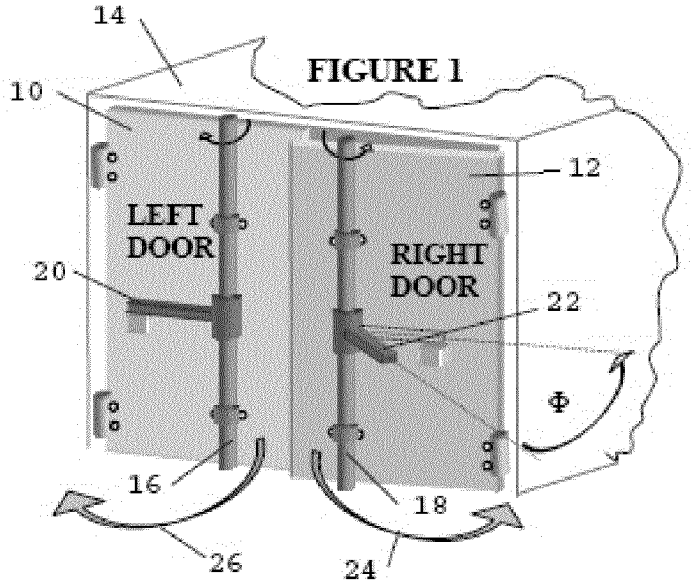
FIG. 1 is a schematic illustration showing a typical door locking system of the type used on large shipping containers.

Referring to the simplified showing in FIG. 1, shipping containers used in the long distance transport of goods typically have locking doors 10 an 12 provided in at least one end of each container 14. The doors, hinged on their opposite sides, close towards the middle and are retained by vertical locking rods 16 and 18 which must be rotated from a locking configuration to an unlocked configuration before the doors can be opened. Handles 20 and 22 are provided on the vertical locking rods to facilitate the locking/unlocking operation. A universal format has been established that will not permit the "LEFT" door to be opened until the "RIGHT" door is opened. When the RIGHT DOOR handle is lifted and moved in a clockwise motion, a rotation of Φ degrees of the locking bar rod allows the RIGHT DOOR to be opened in the direction of the arrow 24. Thereafter, the LEFT DOOR can be opened by rotating its corresponding locking bar rod and causing the door to swing open in the direction of arrow 26. If the RIGHT DOOR handle is not initially moved and the door is not opened, the LEFT DOOR will likewise stay locked and closed. The vertical locking bar rods are attached to the doors and move with them.

Figure 2:
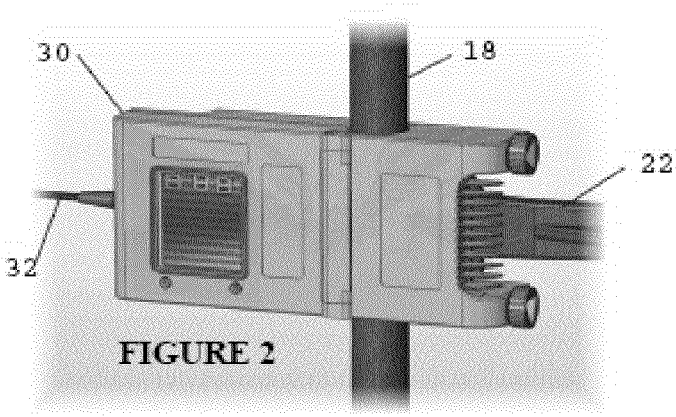
FIG. 2 is a three dimensional rendering of a security monitoring apparatus in accordance with the present invention and mounted on one of the vertical locking rods of a container.

It is an intent of a first embodiment 30 of the invention shown in FIG. 2, to monitor the doors status by sensing movement of the RIGHT DOOR handle 22 carried by the vertical locking rod 32, since it must be moved to allow entrance into the container. It is also an intent of this embodiment of the invention to detect whether or not the LEFT DOOR has been opened. It is also an intent of this invention to annunciate the opening, tampering or entrance through the RIGHT DOOR and/or the LEFT DOOR with audio/visual status indications in forms which might include a color changing display as provided by light emitting diodes (LEDs), an acoustic alarm, a radio transmitter, a memory and/or other features as will be explained below.

This embodiment features a unit that will clasp onto the handle carrying rod 18 as indicated in FIG. 2, and will sense any movement thereof. The unit has an extension 32 of its sense technology that, as will be described below, stretches between the two doors and hence monitors any entrance after the doors are opened. The unit 30 attaches to the door rods and operates from a battery power source for many days. The unit is installed and initiates operation at a starting time and place, and is removed at an ending time and place, and keeps time records of any tampering event in a solid state memory during the installed period. The unit is so constructed as to allow it to be disposed of at the end of the transit period.

The unit 30 provides a sophisticated and low cost electronic monitor for the shipping container industry. Its functionality includes the ability to monitor several door opening and tamper points on most standardized containers, and to annunciate a breach into the container's door closure.

The unit 30 is battery powered and operates for up to 60 days while the container to which it is affixed is in storage and/or transit. With its resident microprocessor, the unit keeps track of time during the installed period and records the time event of any breach condition. Breach monitoring is accomplished using unique, high technology means including special sensors that are highly immune to faults from environmental conditions, vibration and aging. Multi status display techniques are utilized that include a visual red and green color changing panel, colored lights, sound and a radio architecture that sends alarm status remotely. The unit offers optional RFID communications per standards that meet the requirements of the International Organization for Standardization.

As depicted in FIG. 2, a unit 30 in accordance with a first embodiment of the invention is adapted to engage and be securely affixed to the vertical locking rod 18 of most all containers built to current standards. The unit is configured to interfere with the outer wall of the associated door 12 so as not to rotate with the rod 18 should the rod/handle be tampered with.

Figure 3:
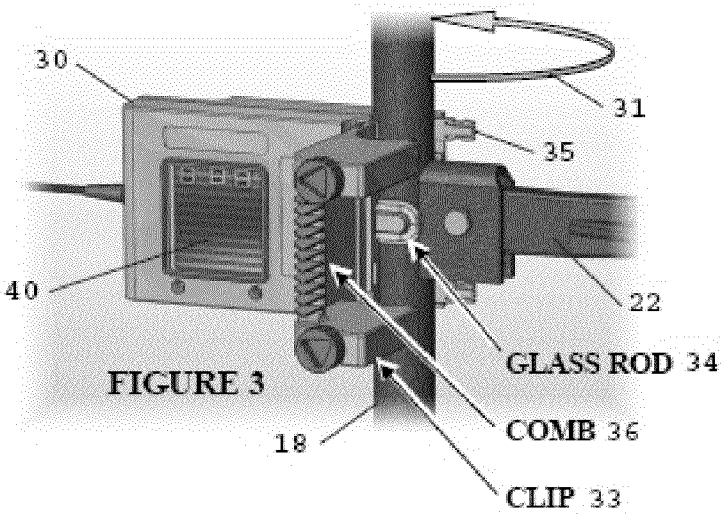
FIG. 3 is a view of the apparatus of FIG. 2 but shown in its open configuration.

The locking "CLIP" design, depicted in its unlatched and open configuration in FIG. 3, permits easy installation by simple rotation of the CLIP 33 relative to the housing 30, as indicated by the arrow 31, and into latching engagement with bayonet type fasteners 35 requiring only a few seconds of time. Once so attached, as will be described below, the "CLIP" 33 keeps the unit firmly attached to the rod 18 throughout the duration of its use.

As illustrated in FIG. 2, when the "CLIP" function locks the unit in place about the rod, the unit arms and initiates operation. A special frangible "GLASS ROD" 34 extending from the housing in the "COMB" section 36 is disposed in the way of rotation of the handle 22. Since the unit can not rotate with the rod 18 because of interference with the door 12, moving the handle forward causes the rod to slip with the grip of the unit resulting in the handle breaking the glass rod 34 and interrupting the path of electronically controlled pulses passing through the glass rod. This sets off the alarm and causes visual, acoustic and radio status conditions to change resulting in alarm annunciations of several types as will be described below.

Figure 4:
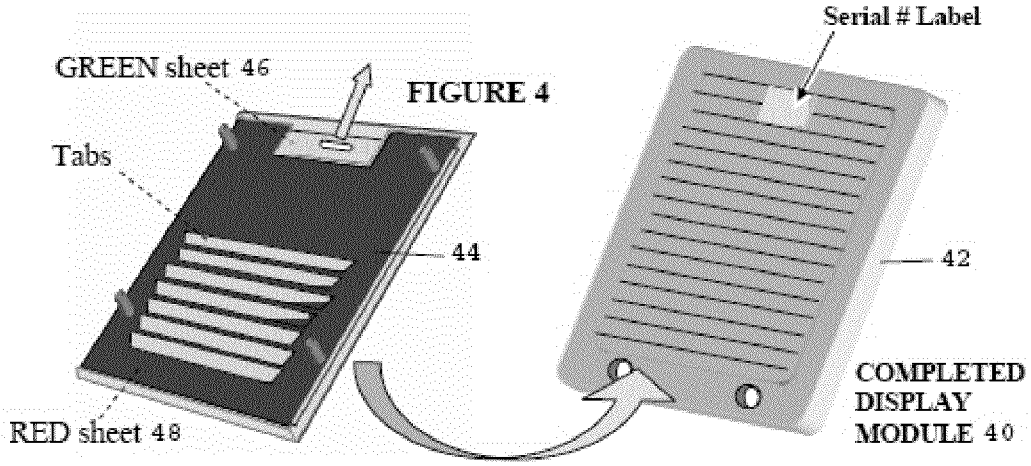
FIGS. 4-6 illustrate external details of a GREEN-RED tamper sensing and indication system in accordance with the present invention.

A feature of this embodiment of the present invention is the color changing a GREEN to RED STATUS change in a DISPLAY MODULE 40. This technology is disclosed in detail in U.S. Provisional Patent Application Ser. No. 61/140,815 filed on Dec. 24, 2008, entitled "Multiple Interlaced Display Using Windowed Sheets", by Victor Ivashin and Heather Ivashin, and such disclosure is expressly incorporated herein by reference. The Display allows interlaced sheets of colored material to slide relative to each other and through slits to form color fields that change when a slider is activated. See FIGS. 4, 5 and 6.

The DISPLAY MODULE 40 includes a plastic housing 42 that contains the working slide mechanism 44 described in the cited invention disclosure. This DISPLAY MODULE is a component in the present embodiment, and the activation of a slider to make the transition of the GREEN to RED state is under the control of a spring loaded PULL that un-meshes the interleaved GREEN and RED color sheets 46 and 48. As suggested by the showing in FIG. 6, the large frontal panel of color thus changes when an alarm is triggered by an electronically activated process to be described later. The color change occurs in less than a second and is not reversible.

Figure 5:
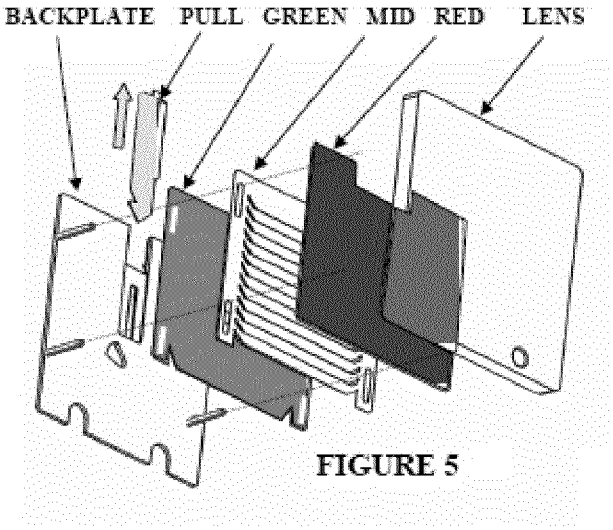
Figure 7:
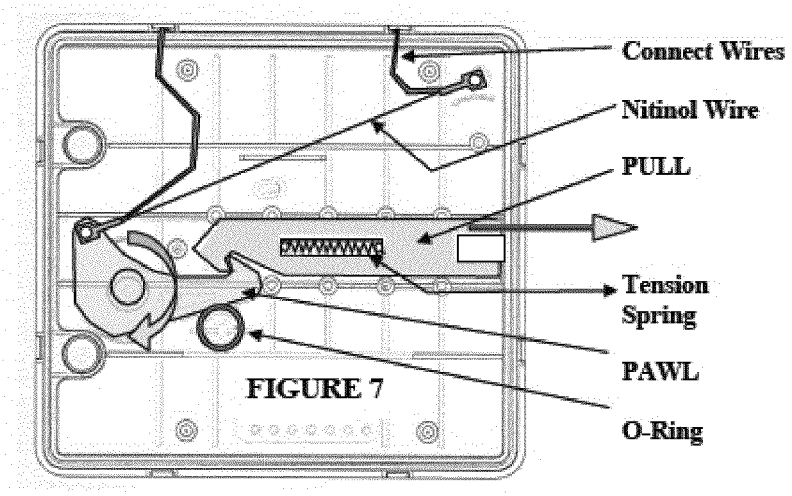
FIG. 7 illustrates internal details of the GREEN-RED tamper sensing and indication system shown in FIGS. 4-6.

As suggested above, the mechanical visual display component is implemented as a module including multiple components (as can be seen in FIG. 5). As shown in FIG. 7, on the back of the module (BACKPLATE), a spring loaded PULL is held open by a toothed PAWL under control of a length of nickel-titanium wire (nitinol), having properties that shrink the wire's length when heat is applied. The PULL engages the frontal meshed color sheets with a tab that protrudes through the BACKPLATE and into slots in the meshed sheets on the front of the Display Module.

The Nitinol Wire is activated (shrinking in length) when an electric current is passed through it, heating the wire. This releases the PAWL. An O-Ring is used to provide a loading force on the PAWL to keep it engaged with the tooth of the PULL. The PAWL rotates to release the PULL.

As will be further explained below, each of the GREEN to RED STATUS Displays is serialized with one of 1.6 million different numbers to match two other similar labels on the main enclosure and "CLIP" of the unit. The serial tags are printed on a reflective holographic surface. Further, they provide a release agent that divides the label into patterned and broken sections if an attempt is made to remove them, this proving a tamper revealing feature. This insures unit-to-unit uniqueness as the three serial number labels must match; the label on the GREEN to RED STATUS Display, a label on the main enclosure, and a label on the "CLIP" (the hinged portion that grabs the vertical locking rod). The labels carry at least 4 alpha-numeric characters that change per unit. Each character's attribute is hence from a set of 36 (26 alpha+10 numeral) possibilities. This allows $36^4$ combinations.

The GREEN to RED STATUS Display is visible from at least 100 feet away and a simple, all GREEN STATUS panel depicts an un-tampered container closure while a RED STATUS panel indicates that a tamper or entrance event has occurred. The GREEN STATUS further has a holographic reflective (mirror) silver matrix sheet that acts as a "MID" sheet to deter replication. See FIG. 5.

The entire GREEN to RED STATUS Display is shielded at the frontal exposure by a LENS piece of tempered and hardened glass so that any intrusion or tamper event will result in highly visual broken glass. Tempered glass shatters into many pieces and the tamper event becomes obvious.

Figure 6:
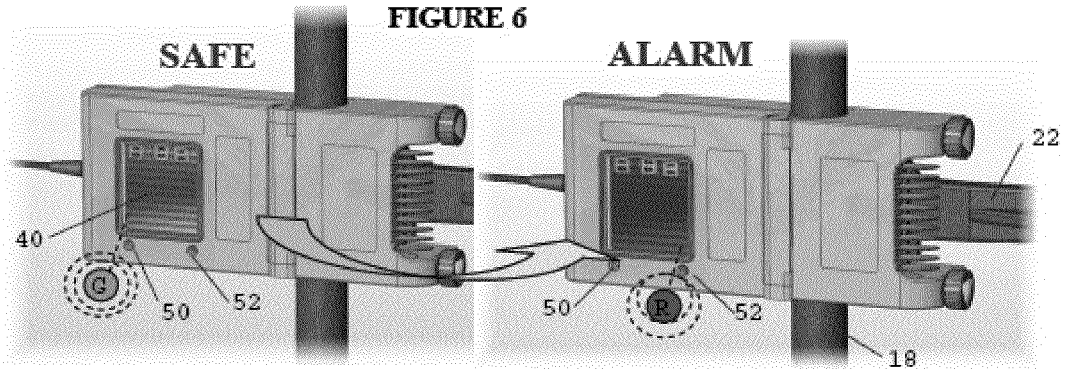

As shown in FIG. 6, in suite with the status of the GREEN to RED STATUS Display, two frontal lights 50 and 52 in the form of flashing light emitting diodes (LEDs) allow night time status verification. These LEDs are visible from at least 100 feet. A GREEN STATUS flashing LED depicts an un-tampered container closure while a RED STATUS flashing LED indicates that a tamper or entrance event has occurred. Once the GREEN STATUS is lost, it cannot ever come on again due to microprocessor and electronic controls as described below. The flashing of the RED LED and the GREEN LED occur at different intervals; in a GREEN STATUS the unit flashes at a predetermined rate "G-RATE", for example once a second, while in a RED STATUS the flash will be at an "R-RATE", for example, once every two seconds. This feature further establishes the difference between the GREEN STATUS and the RED STATUS conditions. The flashing GREEN STATUS and flashing RED STATUS are independent of the GREEN to RED STATUS Display 40. The RED LED and the GREEN LED also serve as the visual "heart-beat" of the unit and indicate proper and powered operation.

The high impact plastic enclosure for the unit is designed to withstand harsh environmental conditions and is waterproof and temperature tolerant. All access to the inside has been disabled and several of the components are hermetically sealed. The unit can operate within the −40° C. to +75° C. range defined in the ISO standards.

Door Handle Rotation Movement Sensor

The rotational movement of the vertical locking rod of the container (that includes the primary access handle and door locking cam or latch) is monitored using three separate sensing techniques and devices.

Figure 8:
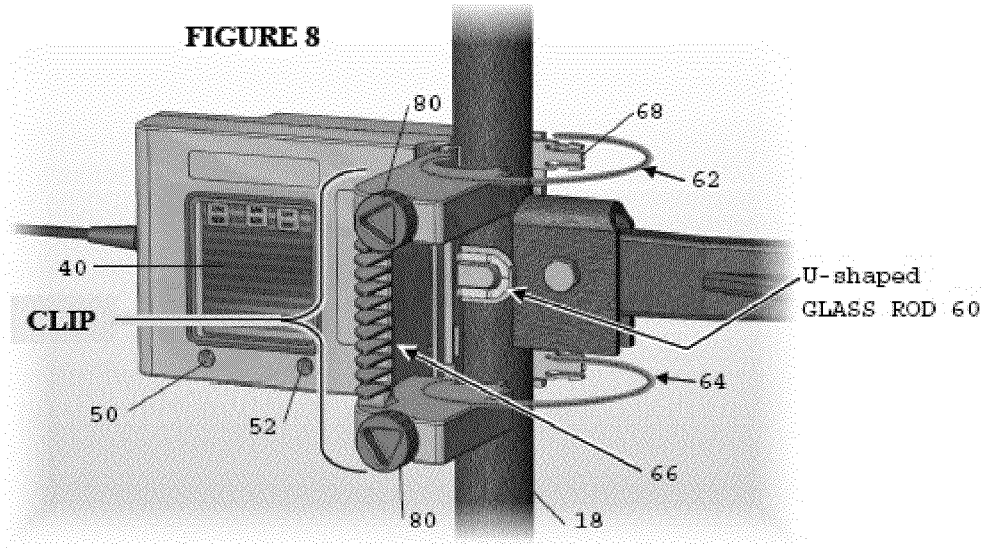
FIG. 8 illustrates details of a second sensing feature included in the embodiment of FIGS. 2-7.

As shown in FIG. 8, the first is an electronically monitored light path within a "U" shaped GLASS ROD 60 that projects from the main housing, monitors the frontal zone of the handle, and breaks if the handle is rotated, thereby setting off the alarm. Light pulses are sent through the GLASS ROD at intervals, sensed by a microprocessor or dedicated digital logic. Breaking the GLASS ROD 60 breaks this optical path and triggers the tampered state alarm. Once broken, the GLASS ROD is non-restorative, ensuring a RED STATUS alarm.

The second sensing technique is within the design of the "CLIP", the grasping portion of the enclosure. Once rotated into place as depicted in FIG. 6, the "CLIP" is electrically monitored for circuit path breakage with two electric current loops 62 and 64. These LOOPS are wires inside the "CLIP" that form a circuit around the vertical locking rod and are connected electrically only when the "CLIP" is firmly in place on the vertical locking rod 18. Should the "CLIP" be opened, the electrical conductivity will be lost and the tamper state will be detected. Any breakage of either of these two LOOPS triggers the alarm.

When the GLASS ROD 60 is broken, or the "CLIP's" circuit paths are opened, the alarm is set, the GREEN STATUS Display 40 becomes RED, and the RED STATUS light 52 is illuminated. Further, by option, and if implemented, radio alarming pulses will be generated, the RFID device will be activated, and the microprocessor will record the time of this event. Another action may also be programmed in response to the alarm.

The third sensing technique is a visual one. Referring again to FIG. 8 it will be noted that the "CLIP's" design includes a COMB-like series of short plastic extensions 66 that will break off if the handle of the locking rod is rotated away from its locking position. These plastic extensions are highly visible and act as tamper evident flags.

Door Access Sensing—RED SENSE LOOP

Figure 9:
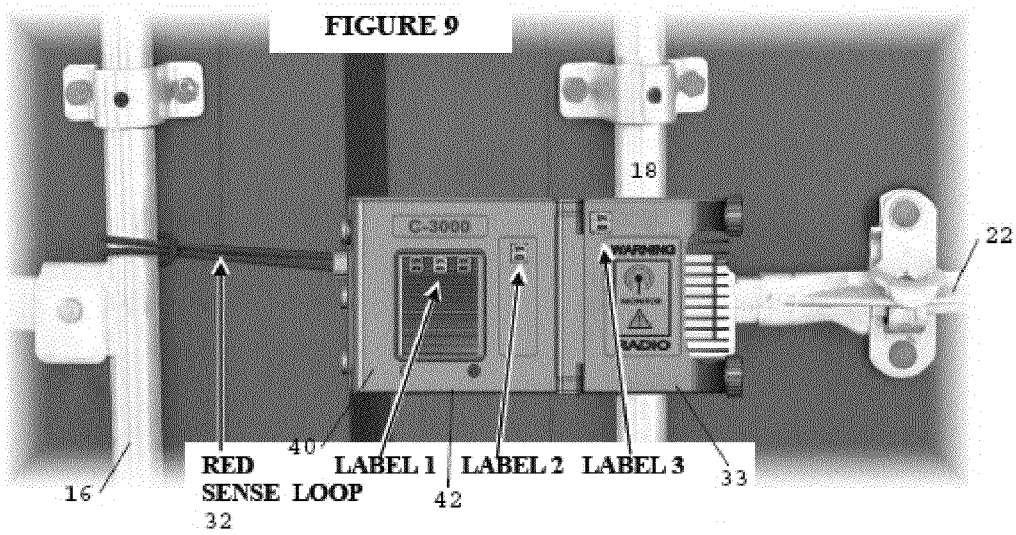
FIG. 9 illustrates a RED sense loop feature and tamper evident labeling feature of the embodiment of FIGS. 2-8.

As depicted in FIG. 9, when a unit is attached to a container, a RED SENSE LOOP 70 extends to the left to go around the secondary LEFT DOOR locking rod. This loop is a multi-wire cable that has patterned current pulses moving through it, monitored by the unit. This cable may also be an optical fiber cable in a variation of this portion of the embodiment.

Neither the right side DOOR nor the left side DOOR of the container can be opened without violating this RED SENSE LOOP or removing the unit. Either of these events trigger a RED STATUS alarm.

When the RED SENSE LOOP circuit path is violated, the alarm is set, the GREEN STATUS Display becomes RED and the RED STATUS light is illuminated. Further, by option, and if implemented, radio alarming pulses are generated, the RFID device will become activated, the microprocessor will record the time of this event, or another action may be programmed to respond to the alarm condition.

Security Labeling

As is shown in FIG. 9, several tamper-evident labels define the serial number of the three main physical component parts of the unit. These are the DISPLAY MODULE 40 (LABEL 1), the MAIN BODY 41 (LABEL 2), and the CLIP 33 (LABEL 3). Their application has been described above.

Use of Bar-Code Labels

An industry accepted bar code label can also be applied as an optional way to remotely scan in the serial number of the unit; the number representing a way-bill number, a container tracking number, shipment reference number or some other number of importance to the user of the container.

Powering the Unit

The self-contained batteries used in the unit are housed in a special Power Module that is removed and recycled after the container has reached its destination. The Power Module becomes functional only when the unit is placed onto a container's vertical pole as contacts on the Power Module engage into a receptacle only after the CLIP 33 is firmly seated onto a vertical locking rod 18. The batteries are based on state-of-the-art lithium technology which allows 120 days of storage prior to the 60 days of armed operation. An expiration date is stamped on the Power Module, providing awareness as to the service life. The batteries may be of variant form and voltage depending on the application.

Attachment of the Unit

The disclosed embodiment has been designed to permit ease of attachment. When received, the unit is taken out of its shipping package in a factory preset state with the CLIP portion already opened and ready to be attached to a container's vertical locking rod. At this time, the unit is inactive electrically in that the Power Module has been placed in a shipping orientation, providing no power to the unit. The RED SENSE LOOP cable is now placed around the container's secondary door locking rod 16 (LEFT DOOR) and looped back on itself to provide a hold. This action requires the unit to be "threaded through" the loop after the loop is wrapped about the vertical locking rod 16.

By pushing the Power Module (FIG. 13) inwards with a finger, or with the container's locking rod, the electronics component of the unit contained within the main housing is enabled. At this point the installer has 60 seconds to complete the mounting of the unit. The unit and the CLIP 33 are placed onto the locking rod 18 and the CLIP is rotated to clamp and slide side-ways to allow 4 self-fasteners 68 (FIG. 8), to lock into place. This establishes connectivity of the loops 62 and 64 (FIG. 8) and starts the electronic monitoring 30 seconds after firm attachment of the is sensed. The CLIP's two pole tightening knobs 80 can also now be twisted to firmly affix the unit to the pole.

After 30 seconds, the GREEN STATUS Display will commence with the GREEN light flashing at its set rate, completing the attachment and arming procedure.

Removal of the Unit

At the end of the transit, the unit is removed by simply pulling the handle of the locking rod and opening the door. The indicating COMB 66, the GLASS ROD 60 and the connective straps 62 will break away under the pressure of the door handle. The RED STATUS will appear and the unit can be removed from the locking rod. The batteries will continue to operate the unit in ALARM condition for up to 60 days from the time the unit was energized. If the unit is not to be interrogated for data, the user must remove the Power Module and re-cycle it according to the directions printed on the label of same. A pull handle is provided to remove the Power Module. The plastic enclosure and the rest of the unit, without batteries, is RoHS compliant and can be re-cycled. The unit is a one-time-use monitor.

Interrogation of Data

At the end of the transit period, the unit may be interrogated for data. This requires use of the RFID architecture described below. When the unit went into RED ALARM mode, or another monitored condition, data was stored within the micro-processor's non-volatile memory and simultaneously made available to the RFID portion of the design. This data is preserved even after the power is removed, and through RFID interrogation can be extracted from the unit by an external read device.

Architecture Safety

The microprocessor electronics feature a knowledge of all power up, monitor and power down cycles, and are so configured as to permit them to occur only once. When an ALARM or other condition is sensed, proprietary circuits alter the unit to not allow a subsequent event sense operation. The GREEN STATUS state can only occur once, even if the electronics is recovered and forced to power-on again. All microprocessor commands are coded and scrambled. This is a sophisticated type of "electronic fuse" that protects the architecture from being copied or the unit used again.

For a visual summary of the main parts of the unit when in position on a container locking pole, see FIG. 10. For a visual summary of the main parts of the unit when the CLIP is OPEN, see FIG. 11.

Provision of External Ports for Sensing or Control Functions

As illustrated in FIG. 12, the enclosure is enabled for external communication via "PORTS" that provide cable access to the internal portions of the unit. These are sealed until they are deployed and provide a way for peripheral sense or control wires to interface with the unit.

Parts and Pieces of the Unit

FIG. 13 pictorially depicts the several components of a disassembled unit.

Various techniques and assemblies were experimented with before arriving at the above described preferred embodiment. However, it is important to note that there are other variations of hardware that may be likewise be used to implement the present invention. Similarly, other variant materials may be used to accomplish the goals set forth in this disclosure.

The use of specialty plastics to accommodate the wide temperature extremes into which the unit is exposed is an important consideration. Nylon was used whenever possible, and the anticipation of strength reinforced ABS and PVC was also considered. The above described implementation of the invention is not limited to use of any of the specific materials described above.

Electrical Block Diagram and Discussion

The basic operation of the unit revolves around the elements and circuit illustrated in FIG. 14 which represents the electrical layout of an embodiment of the invention. It is to be noted that the unit has a hard-wired logic architecture that is augmented and controlled by a local micro-processor. The design features a way for the unit to survive a failure of the micro-processor as will be seen in the discussion that follows. Not shown are the batteries that are used to power the circuitry when the unit is attached to a container locking pole. The batteries have no power regulator in series with the load. Although conventional low power digital and analogue circuits were used, it is noted that the design can readily be implemented as a single integrated circuit, as a gate array, as a RISC micro-processor, or in some other electrical form.

The Analogue Heart Beat Unit A, is an oscillator that provides a clock that is apart from any clocking in the microprocessor and provides a pulse that has a period of approximately one second and a pulse width that is 15 milliseconds long in its active state. These pulsed signals are routed to Block C and Block D, which are respectively, the drivers for the RED and GREEN LEDs described above. The output of Block A is also routed to the INT interrupt line of the Microprocessor E, to act as a timing co-ordinator. The output of Block A is also routed to the Delay Line Pulse Train unit J, and used to sequence a state machine delay line. The oscillator of Block A can be constructed to be of variant type, although a Schmidt trigger feedback oscillator was implemented in the described embodiment. Relaxation, Hartley, Colpitts, divided down crystal oscillators or other types of oscillators can alternatively be used. The oscillator of Block A runs continuously during operation of the unit.

The RED-GREEN FLIP-FLOP B, is a bi-stable latch that is reset upon power-up and controls and enables the two LED drive circuits in Blocks C and D. This flip-flop sets the status state of the unit to be either the GREEN safe state or the RED alarm state. When reset, the RED-GREEN FLIP-FLOP is in the GREEN state and enables the GREEN LED D circuit to flash at the rate given it from the Block A circuits. The RED-GREEN FLIP-FLOP B can also be controlled by the Micro-processor E, to be held off, to be set or to be reset. As the Micro-processor determines the alarm condition(s), it can hence set or reset the RED-GREEN FLIP-FLOP which of course enables either the GREEN or RED LED circuits.

Block C is the driver for the RED LED and is basically a charge pump and transistor driver that is gated by the correct term from Block B. When the RED-GREEN FLIP-FLOP is reset, Block C is disabled. When enabled, this circuit flashes the RED LED at the rate of the Block A clock for the active time of 15 milliseconds.

Block D is the driver for the GREEN LED and is basically a charge pump and transistor driver that is gated by the correct term from Block B. When Block B is set, Block D is disabled. When enabled at reset, this circuit flashes the GREEN LED at the rate of the Block A clock for the active time of 15 milliseconds.

The Micro-processor E accomplishes several functions that relate to the operation of the unit including control decisions that accomplish the following:

a. Set or reset the RED-GREEN FLIP-FLOP B.
b. Toggle the INDEPENDENT WATCH_DOG H to reset its counters.
c. Scan the 4 major "evidence of tamper" circuits and formulate an action.
d. Hold off all activity during power-up or attachment cycles.
e. Activate the acoustic Device O.
f. Communication with radio and RFID circuits.
g. Sense the voltage level of the power supply batteries.
h. Arbitrate the GREEN or the RED status of the unit.
i. Activate the wire PULL by placing current onto the nitinol wire, to change the Display from GREEN to RED.
j. Initiate a timer in memory that keeps track of the time from first power-up (and attachment) to the time event of the first tamper or alarm.
k. Receive the Analogue Heart Beat pulses and process them for both timing and system analysis.

The Micro-processor E has all of its operational memory, including the operating code, the temporary registers and storage, the registers for update and history and the working random accessed memory in the form of flash memory. This means that certain values will survive even in the event of a loss of power. Further, the code (program) memory is downloaded through a serialized pin format during initial manufacture.

After reset (power-up), the Micro-processor E must hold all of the error processing and indication in a frozen state until the person placing the unit on a container is finished latching it into place. This process may take a minute or two and the Micro-processor E will use its hold-off logic to keep the RED-GREEN FLIP-FLOP B from setting to the RED status during this interval.

Once the unit has been attached and enabled, it is the duty of the Micro-processor E to receive signals on its INT line, showing that the clock circuits are functioning and to resultantly output a toggle pulse to the INDEPENDENT WATCH_DOG H to keep its counter from over-running. The WATCH_DOG H is tasked with observing the proper operation of the Micro-processor, and if the Micro-processor cannot supply it with regular pulses, an error condition will result with the assertion of the RED status.

Another function of the Micro-processor E is to allow current to flow into the PULL wire for the transitioning of the GREEN to RED Display module. This is a single pulse that occurs when the unit goes into a RED status, and at this time the Micro-processor must program a byte in its memory to indicate that a RED status has occurred. This byte is then looked at during every power-up operation to immediately be the flag that places the unit into a RED status.

Still another function of the Micro-processor E is to examine the status of the peripheral light pipe (GLASS ROD) loop and determine whether the signals are still passing through the loop. And if not, to instigate a RED status.

A further function of Micro-processor E is to examine the status of the peripheral wire LOOPS (in the CLIP) and to determine whether or not the signals are still passing through the loops. And if not, to instigate a RED status.

Yet another function of Micro-processor E is to examine the status of the peripheral wire RED WIRE LOOP (at the LEFT DOOR vertical locking rod) and to determine whether or not the signals are still passing through the loop. And if not, to instigate a RED status.

From the time the unit is enabled on the shipping container, or other application, a record of past time must be kept and the Micro-processor E can accomplish this in two ways. The Micro-processor has a crystal oscillator that runs its timing, and as such it can accurately count real time into a register that stops accumulating at will or at the time of a first tamper. The register will have a histogram of the required time lapse. Another time keeping function is to count the number of INT pulses that come from the Block A. This may not always be the most accurate time keeping record, however, as the Block A circuit is derived from an analogue oscillator without conventional crystal or tuned accuracy.

Also stored in the histogram will be the identity of the event that transpired to make the unit record a tamper or security breech event.

Also stored into the Micro-processor's flash memory will be the various serial numbers, freight numbers, codes, container numbers, way-bill records and customer names which may also include primary shipping information that relates to origin and source. The serial number of the unit is also stored in the Micro-processor's flash memory.

Micro-processor E has the ability to transfer data in the flash memory (including all constants and variables) to an RFID, or other peripheral device having a four wire Serial Peripheral Interface Bus (or SPI bus).

The QUAD DRIVER F is a logic element in the 74xx244 family of logic that allows the multiplexing of two sets of 4 lines from the rest of the logic to and from the Micro-processor. Four lines are input and 4 lines are output. A controlling term from the Micro-processoror switches the enabling of each group of four using 4 input-output peripheral lines of the Micro-processoror.

The four inputs are:

-IR ERR When the infra-red GLASS ROD light is not seen
-REDWIRE ERR When there has been a cut in the RED WIRE (left-hand rod loop)

-CLIP ERR When the CLIP circuits have been broken in any way.

-AUX ERR When any external or peripheral (optional) error/alarm has occurred.

The four outputs are:

-BEEP Used as the signal to activate the acoustic "beep" annunciation alarm.

-SET RED Sets the RED state by setting the RED-GREEN FLIP-FLOP B.

-WIRE ON Signal activates the nitinol PULL wire in the GREEN-to-RED Display

-SET DOG This signal toggles the INDEPENDENT WATCH DOG safety circuit

The DISPLAY PULL WIRE G is a circuit that is designed as a driver transistor that activates current into the GREEN-to-RED Display's nitinol PULL wire as discussed above. When a situation causes the RED status to appear, the Micro-processor E will activate this circuit. The circuit for the PULL wire can also be activated by the WATCH_DOG H timing out. The WATCH_DOG circuit is normally reset at intervals under control by the Micro-processor, and should a failure exist within the Micro-processor, the WATCH_DOG H will activate the DISPLAY PULL WIRE G. A timing circuit in the DISPLAY PULL WIRE G activates the PULL nitinol wire for 4 seconds and then disables the circuit. This is done to reduce current in the system after the condition goes towards a RED status.

The WATCH_DOG circuit is normally reset at intervals under control by the Micro-processor, and should a failure exist within the Micro-processor, the WATCH_DOG H will activate the DISPLAY PULL WIRE G. The WATCH_DOG is basically a running counter that has a full cycle time on the order of 2 to 4 seconds but can be reset by an external signal, herein being provided by the Micro-processor E on a regular interval of slightly over one second. All is fine as long as the Micro-processor provides the pulses to keep clearing the counter. When the pulses are absent and the counter over-runs, the design flags this as a failure in the Micro-processor for whatever reason. The WATCH_DOG H then sets the RED-GREEN FLIP-FLOP (setting the RED alarm status state) and activates the DISPLAY PULL WIRE G. This action sets the RED status state which locks out any indication of the GREEN status. The WATCH_DOG H is a single integrated circuit and is available in many time periods from many manufacturers.

The DELAY LINE PULSE TRAIN J receives the master clocking signal from the Block A, this being a 15 millisecond pulse at intervals of 1 or more seconds and time shifts the signals 3 times through the use of resistive-capacitive (integration) networks. This establishes delayed pulses that form a sequence which will be used to progressively scan the 4 input-output conditions that need to be examined and acted upon to create the known status of the system. Each of the pulses created is identical but delayed an increment of time.

The IR LOOP PULSE T/R K is a logic and driver module that when activated will place a pulse towards an infra-red LED that transmits the resultant light pulse through the GLASS ROD loop that exists to monitor the RIGHT HANDLE of the unit. A pulse returning indicates all is well. Simultaneous with creating the pulse of light a flip-flop is set within the block that may be reset when the light returns. A decision block then either validates the return or sets an error named -IR ERR which will be sent back to the Micro-processor E for decisive processing. The first of the pulses coming from the DELAY LINE J will be used to establish the time for this "scanning".

The Wires on Red Cable T/R L is a logic and driver module that when activated will place a pulse towards a current generator that transmits the resultant current pulse through the RED WIRE loop that exists to monitor the LEFT vertical rod attachment of the unit. A pulse returning indicates all is well. Simultaneous with creating the current pulse a flip-flop is set within the block that may be reset when the light returns. A decision block then either validates the return or sets an error named -REDWIRE ERR which will be sent back to the Micro-processor E for decisive processing. The second of the pulses coming from the DELAY LINE J will be used to establish the time for this "scanning".

The Wires on CLIP T/R M is a logic and driver module that when activated will place a pulse towards an current generator that transmits the resultant current pulse through the CLIP LOOP wires that exists to monitor the attachment to the RIGHT vertical locking rod of the unit. A pulse returning indicates all is well. Simultaneous with creating the current pulse a flip-flop is set within the block that may be reset when the light returns. A decision block then either validates the return or sets an error named -CLIP ERR which will be sent back to Micro-processor E for decisive processing. The third of the pulses coming from the DELAY LINE J will be used to establish the time for this "scanning".

The AUX T/R N is a logic and driver module that when activated will provide a gating pulse to auxiliary logic that may exist on a peripheral printed circuit board. A digital pulse returning indicates all is well. Simultaneous with creating the gating pulse a flip-flop is set within the block that may be reset when the peripheral circuit responds. A decision block then either validates the return or sets an error named -AUX ERR which will be sent back to Micro-processor E for decisive processing. The fourth of the pulses coming from the DELAY LINE J will be used to establish the time for this "scanning".

The ACOUSTIC DEVICE O is a piezoelectric transducer that is activated through a base-driven transistor with the piezoelectric element in the collector circuit. A signal from the Micro-processor named -BEEP will activate this circuit. This signal may be asserted under program control.

The RFID and RF Interface P is a connector that has been set for the deployment of a future RFID device and/or logic. Basically the various important control terms have been brought out to this Interface allowing the Micro-processor E, the WATCH_DOG H and the AUX T/R N portions of the architecture to communicate with this block.

The operation of the inverter Q is to control the gates and drivers used by the Micro-processor to switch the 4 input/output lines from receivers to transmitters, enabling the QUAD DRIVER F to drive or receive signals. A digital logic term from the Micro-processor, -A/B, controls the selection.

The FF R represents an auxiliary flip-flop latch that may be set and reset by Micro-processor E for use by the AUX T/R N. It provides an extra selection term for any logic that may be required in the AUX T/R N at a future date. This flip flop FF R is set where the -BEEP term is asserted, and reset when the -SET DOG/AUX logic term is asserted by Micro-processor E.

The Reset S is a commercial integrated circuit designed to output a reset pulse. At power-up, this block provides 300 to 600 milliseconds of an active low reset signal. The reset signal will be used to reset Micro-processor E, the RED-GREEN FLIP-FLOP B and the peripheral port RFID and RF Interface P.

The Battery Sense, Block T, is a commercial integrated circuit designed to output a logic signal whenever the battery or $V^{cc}$ voltage falls below a certain value. This is essentially a form of reset signal and will be directly placed into the Microprocessor where a decision will be made as to whether or not to set the RED-GREEN FLIP-FLOP B, to power down or to allow Micro-processor E to go into a "sleeping state". In the proto-type the battery voltage was at 3 volts and the circuit used for the Battery Sense Circuit T was set for an alerting signal at 1.8 volts.

The basic operational function of Micro-processor E is portrayed by the flow diagram of FIG. 15.

Alternative Embodiment

In FIGS. 16-27, an alternative embodiment of the present invention is illustrated. The changes in this embodiment include the use of a long rod 100 that retracts into the enclosure 101 and carries a fiber optic cable 102 that loops around the LEFT DOOR vertical locking rod, and an attachment connector 104 which allows the user to loop the cable around the vertical rod and then connect it to the main enclosure.

Figure 17:
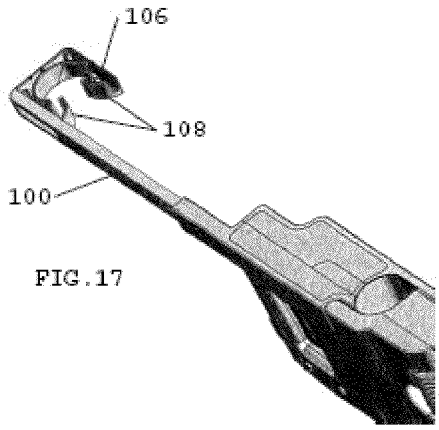
Figure 18:
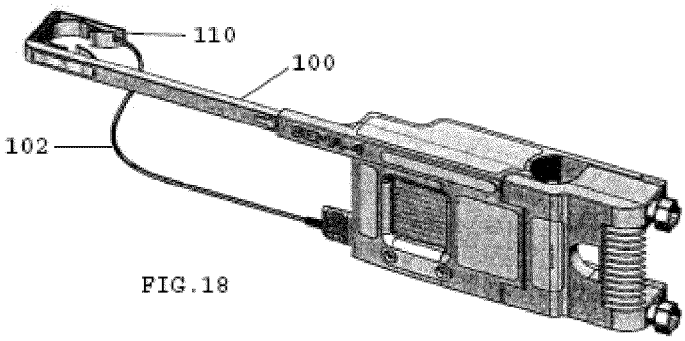

FIG. 17 is a perspective view further illustrating details of the long rod 100 that retracts into the enclosure and a CLAMP 106 formed at the end which can adjust to various vertical pole diameters. The adjustment is made with tabs 108 that protrude from the clamping body and hence, when applied to a cylindrical rod will bend to grasp the surfaces thereof. A groove 110 (FIG. 18) in the tab accepts the optic fiber cable sensing loop.

Figure 19:
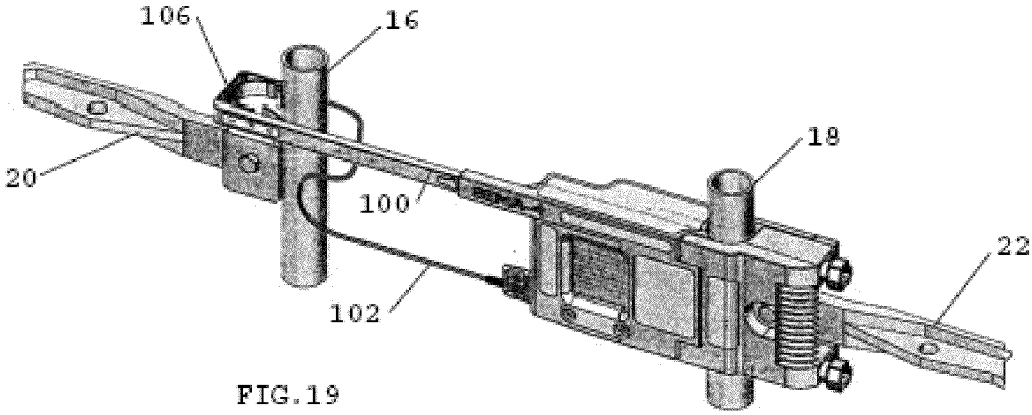

FIG. 19 further illustrates the general form of the enclosure and body of the unit and shows the unit attached to a right side vertical locking rod 18 of a shipping container with the CLAMP 106 being retracted into engagement with the left side vertical locking rod 16. The retracting rod 100 allows the unit to accommodate variant distances between the two locking rods of various shipping containers.

Figure 20:
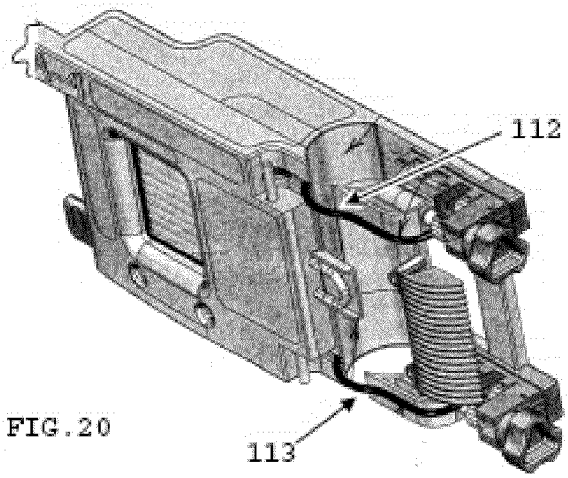
Figure 22:
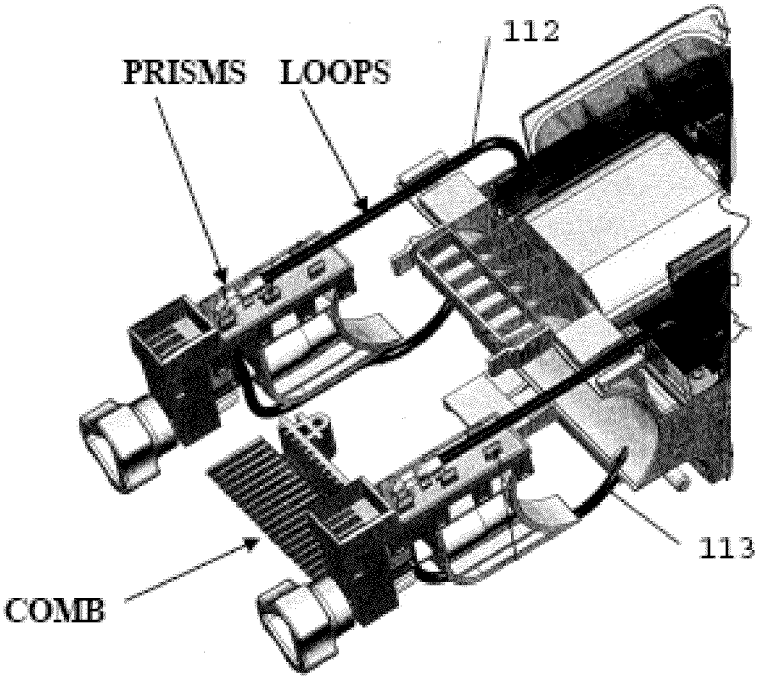

In FIG. 20 the CLIP 114 shown in FIG. 19 is removed to show the paths that the two optic fiber cables 112 and 113 transcend as they pass through the RIGHT DOOR CLIP portion of the unit. These cables flex as the unit is installed and are provided with PRISMS (as shown in FIG. 22) that allow the coupling of the optical paths that complete each loop. The two cables shown at 112 and 113 are each pulsed with light at separate times to allow identification of any tamper or movement of the unit.

Figure 21:
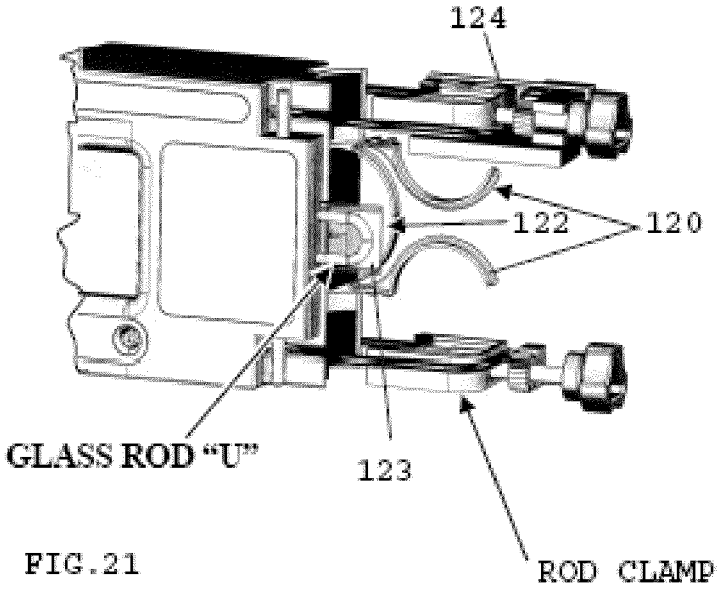

In FIG. 21 tab-like extensions 120 of the battery enclosure 122 are shown which allow one to use two fingers to squeeze the two tabs and remove the battery module. Also noted is the backing plate 123 behind the GLASS ROD that ensures that the GLASS ROD breaks when the handle (shown in FIG. 19) of the RIGHT DOOR vertical locking rod is rotated forwardly. The pushing PLUNGERS 124 that help grip the vertical rod are also seen in this view.

FIG. 22 illustrates the ways the two optical fiber cable LOOPS 112 and 113 thread through the CLIP portion of the unit, the PRISMS that allow the optical fiber cable to mesh and still pass the light pulses through when completely closed, and the COMB feature which can be removed and replaced or be made from a brittle and variant material. The COMB is configured to break away when any tamper occurs, becoming a visual indication of the event.

In FIG. 23 the CLIP is exploded away from the unit body to illustrate the use of the hinge pins 130 to hingedly affix CLIP to the body and allow it to rotate between its open configuration and its rod engaging configuration. The pins 130 are inserted from the inside.

In FIG. 24 the PRISMS that allow the light to pass through the optical fiber sensing LOOPS 112 and 113 disposed in the CLIP are depicted in more detail. Also depicted is the one-way toothed assembly that keeps the KNOBS from turning backwards. The KNOBS are used to tighten the assembly onto the vertical locking rod, and the spring loaded PAWL engages the teeth on the KNOB shaft.

This embodiment of the invention differs from the first above described embodiment in both mechanical detail, as described above, and in electrical detail. Signal handling changes have been implemented in this alternative embodiment to simplify the design of the micro-processor and the logic that surrounds it and those changes are described herein.

A change was made to the WATCH-DOG circuit to allow the circuit to time out to toggle a flip-flop, that flip-flop being responsible for the activation of the nitinol wire in the GREEN to RED Display. The flip-flop sets to activate the wire and resets from a feedback path from a contact on the wire itself that signals the completion of the wire PULL to change the Display from GREEN to RED.

The Micro-processor was changed and selected to be a SiLabs C8051F920-GM, having a wide selection of I/O and internal analogue capabilities.

All LEDs in the design have been configured to work from an accumulative charge pump circuit. These micro-processor controlled transistors will pump twice the working $V^{cc}$ voltage onto a capacitor and the micro-processor controlled charge will be placed across the two LEDs for GREEN and RED annunciation (one at a time) as well as for four sequenced LEDs that are utilized to place pulses onto the fiber optics that are now an integral part of the sensing circuits in the unit. The micro-processor can now selectively power the anodes of any of the 6 LEDs by activating transistors that provide current to the LED anodes and by then scanning the depletion of the voltage on the capacitor and one of the analogue inputs of the micro-processor. This optimizes the ON time of the LED selected. All the LEDs are sequenced one at a time and the RED and GREEN front panel LEDs are on for times in the milli-seconds range while the other fiber optic source LEDs are typically on for only a few microseconds.

All LEDs in the design that are not the two GREEN and RED visible front panel LEDs pulse into optical fiber pipes that eventually all converge onto two photo-receptors identified as SENSORS in the diagram of FIG. 25. These are connected in an open-collector arrangement as they are photo-transistors. Their common signals will be buffered and a filtration network on the output of the buffer will accumulate signals onto a capacitor on one split leg of the output. This will create an integrated reference level on the capacitor and a signal that fluctuates around that level for use by an analogue comparator that sits inside the micro-processor. This circuit will set the sensitivity for the received pulses of light as well as allowing a wide difference in the ambient levels of the light falling on any of the photo-detectors or fiber optic pipes and cables used in the design of the monitor. A logic term from the micro-processor is used to disable these circuits and conserve power.

The basic BLOCK DIAGRAM has also been changed to make all peripheral sensing fiber optic based. This means that the CLIP on the RIGHT DOOR, the sensing of the LEFT DOOR vertical rod attachment and the GLASS ROD LOOP are all using fiber optical cable as the serial looping technique. The PRISM COUPLERS allow the transition between the inner and outer enclosures and provide a way to allow loops to move and still pass light.

As alluded to above, plastic PRISMS allow the transition between zones and between moving members of the fiber cable that must couple with each other. Such PRISMS are shown in the schematic diagram of FIG. 25 and the pictorial showings of FIGS. 26 and 27. Plastic PRISM COMBINERS allow two fiber cables to couple onto one detector.

Figure 27:
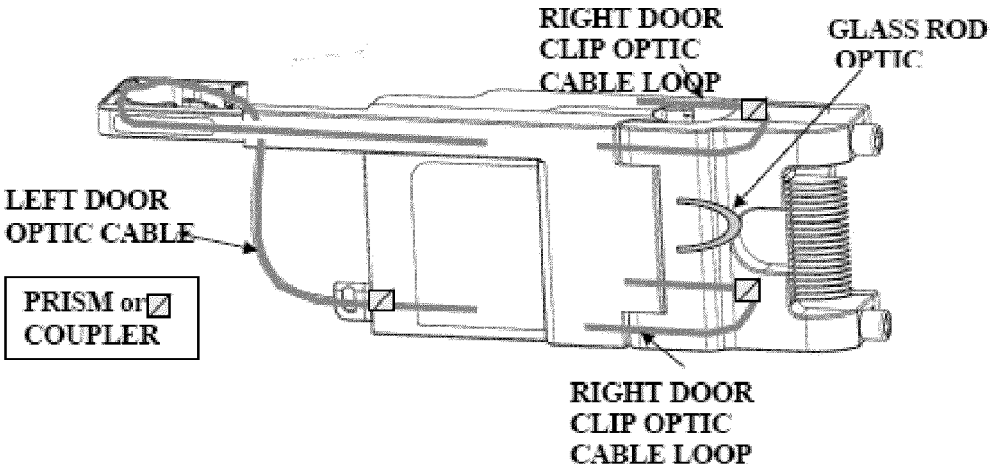

The GENERAL FIBER CABLING is shown in FIG. 27 and include the LEFT DOOR optical cable, the two (RIGHT DOOR) CLIP OPTIC FIBER LOOPS and the U-shaped GLASS ROD; all being part of the FIBER OPTIC CABLING SENSE SYSTEM.

Although we have thus disclosed what we believe to be two optimal embodiments of the present invention, it is anticipated that other alternatives will become apparent to thus skilled in the art and having read this disclosure. It is therefore intended the this disclosure be considered a general teaching and that the scope of the protection afforded will be limited only by a fair interpretation of the claims appended hereto.

The invention claimed is:

1. A security monitor for container doors of the type including locking mechanisms in the form of elongated door locking rods having laterally extending handles for facilitating movement of the locking rods and/or handles between a locking disposition and an unlocking disposition, comprising:

a housing;

securing means associated with said housing for securely affixing said housing to a locking rod and/or handle, said securing means including a clip assembly pivotally affixed to said housing and rotatable between an open position for receiving a locking rod and/or handle, and a closed position clampingly engaging the locking rod and/or handle between the clip assembly and said housing;

sensing means associated with said housing for sensing movement of the clampingly engaged locking rod and/or handle relative to said housing, and in response thereto being operative to generate at least one sense signal; and annunciator means responsive to said sense signal and operative to provide a communicative indication of the locking rod and/or handle movement.

2. A security monitor for container doors as recited in claim 1 wherein the container includes a pair of adjacent doors, with each door having a corresponding locking rod, and wherein said securing means engages both of said locking rods and/or any associated handles when said locking rods are in their door locking dispositions.

3. A security monitor for container doors as recited in claim 1 wherein said clip assembly includes latch means for latching said clip assembly in its closed position, and adjustable clamping means for enabling adjustment of the clamping engagement between said securing means and an engaged locking rod and/or handle.

4. A security monitor for container doors as recited in claim 1 wherein said sensing means includes a light source, a light sensor and a frangible light conductor adapted to normally conduct light between said light source and said light sensor, said frangible light conductor being affixed to said housing and positioned to be engaged and broken by movement of said locking rod and/or handle out of its locking disposition.

5. A security monitor for container doors as recited in claim 1 wherein said annunciator means includes a mechanical display that in response to said sense signal changes from a first display state to a second display state.

6. A security monitor for container doors as recited in claim 1 wherein said housing is adapted to be attached to one of said locking rods by said securing means, and wherein said securing means includes a connecting member for connection to the other of said locking rods, and wherein said sensing means is coupled to said connecting member such that upon unlocking movement of either of said locking rods, said sensing means generates a sense signal causing said annunciator means to be activated.

7. A security monitor for container doors as recited in claim 6 wherein said connecting member includes a loop of electrical conductor forming a circuit that when broken interrupts a signal between a sender and a receiver otherwise communicatively connected thereby.

8. A security monitor for container doors as recited in claim 7 wherein said connecting member includes an extensible arm extending from said housing and having means provided at its distal end for grippingly engaging the other of said locking rods or its associated handle.

9. A security monitor for container doors as recited in claim 6 wherein said connecting member includes a loop of optical signal conductor forming an optical communication circuit that when broken interrupts a signal between a light source and a light receiver otherwise communicatively connected thereby.

10. A security monitor for container doors as recited in claim 9 wherein said connecting member includes an extensible arm extending from said housing and having means provided at its distal end for grippingly engaging the other of said locking rods or its associated handle.

11. A security monitor for container doors as recited in claim 6 wherein said connecting member includes an extensible arm extending from said housing and having means provided at its distal end for grippingly engaging the other of said locking rods or its associated handle.

12. A security monitor for container doors as recited in claim 1 wherein said annunciator means includes a signal transmitter responsive to a sense signal and operative to transmit an alarm signal to a remote receiver.

13. A security monitor for container doors as recited in claim 1 wherein said annunciator means includes a dual state LED optical status indicator responsive to a sense signal or the lack thereof and operative to indicate either a tamper event or the lack of a tamper event.

14. A security monitor for container doors as recited in claim 1 wherein said sensing means includes a microprocessor responsive to said at least one sense signal and operative to actuate at least one indicator included in said annunciator means.

15. A security monitor for container doors as recited in claim 1 wherein said sensing means includes a microprocessor responsive to said sense signal and operative to actuate at least one indicator included in said annunciator means.

16. A security monitor for container doors as recited in claim 1 wherein said sensing means includes light source means and light sensor means communicatively connected together by a plurality of optical signal conductors arrayed throughout said housing and/or said clip and forming detection circuits that when interrupted by movement of said clip relative to said housing cause said sensing means to generate a sense signal, and a microprocessor responsive to said sense signal and operative to actuate at least one alarm indicator included in said annunciator means.

17. A security monitor for container doors as recited in claim 16 wherein at least one of said detection circuits includes a first length of optical signal conductor carried by said housing and a second length of conductor carried by said clip, and a prism coupler for optically connecting said first and second conductors when said clip is rotated into its closed position.

18. A security monitor for container doors as recited in claim 16 wherein at least some of said detection circuits are linked to a single light sensor means by a prism combiner.

19. A security monitor for container doors of the type including locking mechanisms in the form of elongated locking rods having laterally extending handles for facilitating rotation of the locking rods between a locking disposition and an unlocking disposition, comprising:

a housing including a first part and a second part pivotally attached to said first part for containing tamper detection and signaling apparatus;

securing means associated with said first and second parts for securely affixing said housing to a locking rod and/or handle when said locking rod and/or handle is in its locking disposition, said securing means including a clip assembly pivotally affixed to said housing and rotatable between an open position for receiving a locking rod and/or handle, and a closed position clampingly engaging the locking rod and/or handle between the clip assembly and said housing;

said tamper detection and signaling apparatus including sensing means disposed within said housing for sensing rotation of the clampingly engaged locking rod and/or handle, and in response thereto generating a sense signal; and annunciator means disposed within said housing and responsive to said sense signal and operative to provide a communicative indication of the rotation of the locking rod and/or handle.

20. A security monitor for container doors as recited in claim 19 wherein said housing is adapted to be attached to one of said locking rods by said securing means, wherein said securing means includes a connecting member for connection to the other of said locking rods, wherein said connecting member includes a loop of signal conductor forming a circuit that when broken interrupts a signal between a sender and a receiver otherwise communicatively connected thereby, and wherein said sensing means is coupled to said receiver such that upon movement of either of said locking rods, said sensing means generates a sense signal causing said annunciator means to be activated.

* * * * *